United States Patent [19]

Drees et al.

[11] Patent Number: 4,756,633

[45] Date of Patent: Jul. 12, 1988

[54] INKING RIBBON INCLUDING A SUBLIMABLE RELEASE LAYER FOR COLOR TRANSFER UNDER THE INFLUENCE OF HEAT

[76] Inventors: Friedrich-Wilhelm Drees, Duererstrasse 46, D1000 Berlin 45; Hartmut Grethen, Nusshaeherstrasse 47u, D1000 Berlin 27; Friedrich Hagemeyer, Corneliusstrasse 33, D1000 Berlin 46; Wolfgang Pekruhn, Binger Strasse 83, D1000 Berlin 33, all of Fed. Rep. of Germany

[21] Appl. No.: 87,161

[22] Filed: Aug. 19, 1987

[30] Foreign Application Priority Data

Aug. 20, 1986 [DE] Fed. Rep. of Germany ..... 3628194

[51] Int. Cl.[4] ..... B41J 3/20

[52] U.S. Cl. ..... 400/120; 400/241.1; 101/470; 8/471; 8/505; 428/913; 428/914

[58] Field of Search ..... 400/118, 119, 120, 241, 400/241.1; 101/470; 8/468, 471, 505; 428/41, 42, 352, 354, 355, 913, 914

[56] References Cited

U.S. PATENT DOCUMENTS

| | | | |
|---|---|---|---|
| 3,663,155 | 5/1972 | Gray et al. | 8/505 |
| 3,962,513 | 6/1976 | Eames | 101/470 |
| 4,021,591 | 5/1977 | DeVries et al. | 101/470 X |
| 4,027,345 | 6/1977 | Fujisawa et al. | 101/470 X |
| 4,058,644 | 11/1977 | DeVries et al. | 101/470 X |
| 4,453,839 | 6/1984 | Findlay et al. | 400/120 |
| 4,536,437 | 8/1985 | Kawanishi et al. | 400/120 X |
| 4,567,114 | 1/1986 | Oshima et al. | 428/913 X |
| 4,707,707 | 11/1987 | Ohno | 400/241.2 X |

FOREIGN PATENT DOCUMENTS

| | | |
|---|---|---|
| 0096740 | 12/1983 | European Pat. Off. . |
| 3315265 | 10/1984 | Fed. Rep. of Germany . |

OTHER PUBLICATIONS

Patent Abstracts of Japan, V.10, No. 100(M—470), [2157] Japanese Patent Application 60-236791, (Yoshihiro Inaba), 5/10/1984.

"131371a Heat-Sensitive Recording Set", *Chemical Abstracts,* V. 79, No. 19, Nov. 12, 1973, p. 341.

*Primary Examiner*—Ernest T. Wright, Jr.

[57] ABSTRACT

An improved inking ribbon for color transfer under the influence of heat comprises the ribbon having a carrier layer and a colored layer with the heat-soluble release layer interposed therebetween, which release layer is composed of a sublimable material to avoid renewed adhesion of the released portion of the color layer to the inking ribbon after a color transfer to the printing medium has occured.

8 Claims, 1 Drawing Sheet

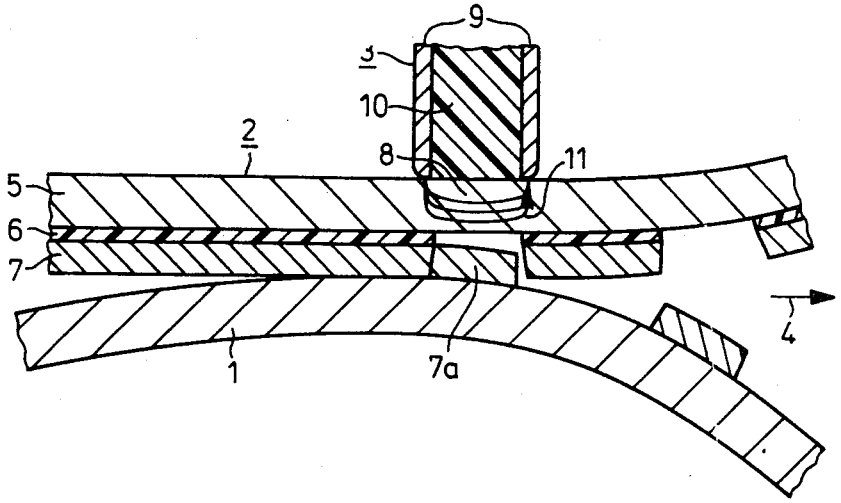
9
3
10
2
8
11
5
6
7
4
1
7a

INKING RIBBON INCLUDING A SUBLIMABLE RELEASE LAYER FOR COLOR TRANSFER UNDER THE INFLUENCE OF HEAT

BACKGROUND OF THE INVENTION

The present invention is directed to an inking ribbon for color transfer under the influence of heat, which ribbon comprises a carrier layer supporting a heat-soluble release layer which holds a colored layer to the carrier layer.

U.S. Pat. No. 4,453,839, whose disclosure is incorporated by reference thereto and which was the basis of European published application No. 0 096 740, discloses an inking ribbon which has a carrier layer which is composed of a solid polymer containing the inclusion of electrically conductive carbon black, and this carrier layer is additionally coated with a thin aluminum layer. A release layer composed of an alcane or crystalline polyethylene having a melting temperature of around 108° C. is applied to the carrier layer or, respectively, to the aluminum layer. A colored layer containing a coloring agent and bonding agent adheres to this release layer. For the printing of a picture element, electrical current is introduced into the electrically conductive carrier layer via electrodes of a thermal printing head. The current flux leads to a local heating of the carrier layer so that the release layer lying therebelow melts to release the underlying portion of the colored layer, which portion is transferred onto a recording medium, which is usually paper and which is brought into contact with the inking ribbon. The inking ribbon must be separated from the recording medium immediately after color transfer in order to separate the applied portion of color from the melted release layer before this release layer solidifies again and the release portion of color can then adhere to it again. To this end, the inking ribbon is drawn away from the recording medium following the printing zone and is drawn away therefrom at a large angle. Thus, a step-by-step feed of the recording medium is, therefore, not possible, and this step-by-step feed is usually required particularly when using thermal printing heads, which comprise printing elements that are arranged in series and are driven successively by groups.

SUMMARY OF THE INVENTION

The object of the present invention is to provide an inking ribbon wherein a renewed adhesion of the cooled color to the inking ribbon is impossible following the color transfer onto a recording medium. This object is inventively achieved in that the inking ribbon is an improvement of an inking ribbon comprising a carrier layer, a heat-soluble release layer for holding a colored layer to the carrier layer. The improvements are that the release layer is composed of a sublimable material.

For example, U.S. Pat. No. 4,567,114, whose disclosure is incorporated by reference and which corresponds to German Patent No. 33 15 265, discloses sublimable dyestuffs being employed, wherein the dyestuffs are sublimated out of the coloring layer and are transferred onto the recording medium. The known inking ribbons, however, do not contain a release layer so that the color transfer procedure is also entirely different.

The significant advantages of the inking ribbon of the present invention is that the sublimable release layer evaporates in the region of the printing zone, given the local heating of the inking ribbon. Thus, a sticking of the color, which is transferred to the recording medium, back to the inking ribbon is no longer possible, subsequent to this evaporation.

A further advantage is that the cooling behavior of the release layer and of the colored layer can be left out of consideration when printing the recording medium. This is different from the known inking ribbons. In particular, it, thus, is no longer necessary to immediately strip the inking ribbon from the recording medium immediately following the printing zone so that the thermal printing heads that are designed only for employment with an inking ribbon without release layer can also be utilized in combination with inking ribbons of the invention.

The release layer of the inking ribbon of the invention is preferably sublimable between 50° C. and 90° C. so that the sublimation temperature, on the one hand, lies clearly above the normal ambient temperature and above the operating temperature of the printer. But, on the other hand, the printing temperature required for printing and, thus, the required drive energy for the the printing heads are relatively low.

In the preferred embodiment of the inking ribbon of the invention, the release layer is composed of either 2-chloroacrylic acid, 5-Nitroquinoline or 2-Chloro-anilin-N-acetate. The release layer, which is stable below the sublimation temperature, is not easily water soluble and the colored layer will adhere well to these particular substances. The sublimation temperature lies at about 50° C. through 90° C. and the substance produced by the volatization when heated are not injurious to a person's health.

Other advantages and objects will be readily apparent from the following description of the preferred embodiment, the FIGURE and the claims.

BRIEF DESCRIPTION OF THE DRAWINGS

The FIGURE is a cross sectional view through an exemplary embodiment of the inventive inking ribbon with the thermal printing head and a recording medium.

DESCRIPTION OF THE PREFERRED EMBODIMENTS

The principles of the present invention are particularly useful when incorporated in an inking ribbon 2, illustrated in the FIGURE.

A recording medium 1, which is usually paper, is conducted past a thermal printing head 3 in the direction of the arrow 4 and the inking ribbon 2 is interposed between the head and recording medium 1. The inking ribbon 2 comprises a carrier layer 5, which is composed of polyvinyl and includes electrically conductive particles of carbon black. The carrier layer 5 carries a release layer 6, which, for example, is composed of either 2-chloroacrylic acid, 5-nitroquinoline or 2-chloro-anilin-N-acetate. A coloring layer 7, which contains dyestuffs is bonded in waxes and faces the recording medium 1, and it adheres to the release layer 6. The release layer 6 is sublimable and volatilizes above a sublimation temperature, which is in a range of 50° C. through 90° C.

The inking ribbon 2 has its carrier layer 5 in contact with the thermal printing head 3 in the region of a printing zone 8. This thermal printing head 3 comprises a plurality of electrode pairs 9, which are arranged obliquely relative to the plane of the drawing, and whose individual electrodes are separated from one another by an insulating member 10.

For the purpose of printing a picture element, a voltage is applied between the electrodes of an electrode pair 9, so that a current, indicated by the lines 11, will heat the carrier layer 5 and a portion of the release layer 6 lying therebelow in a punctiform fashion as the current flows through the electrically conductive layer 5 in the region of the printing zone 8. As soon as the release layer 6 has been heated to a temperature above the sublimation temperature, the substances of the release layer 6 will volatilize so that a portion *7a* of the ink 7, which portion is pressed against the recording medium 1 by the thermal printing head 3, will remain adhering to the recording medium 1. Due to the lack of the release layer 6 in the region of the released portion *7a*, the released ink portion *7a* can no longer adhere to the inking ribbon 2 after the printing zone 8 has cooled so that a faultless color transfer onto the recording medium 1 is guaranteed.

Alternative to the illustrated embodiment, the inking ribbon of the invention, given a non-conductive carrier layer, can also be employed in combination with other heating sources, such as, for example, lasers or thermal printing heads which comprise heating elements.

Although various minor modifications may be suggested by those versed in the art, it should be understood that we wish to embody within the scope of the patent granted hereon all such modifications as reasonably and properly come within the scope of our contribution to the art.

We claim:

1. In an inking ribbon for color transfer under the influence of heat, said ribbon comprising a carrier layer, a heat-soluble release layer on the carrier layer for adhering a color layer, the improvement comprising the release layer being made of sublimable material.

2. In an inking ribbon according to claim 1, wherein the release layer is composed of 2-chloroacrylic acid.

3. In an inking ribbon according to claim 1, wherein the release layer is composed of 5-nitroquiniline.

4. In an inking ribbon according to claim 1, wherein the release layer is composed of 2-chloro-analine-N-acetate.

5. In an inking ribbon according to claim 1, wherein the release layer is sublimable in a temperature range between 50° C. and 90° C.

6. In an inking ribbon according to claim 5, wherein the release layer is composed of 2-chloroacrylic acid.

7. In an inking ribbon according to claim 5, wherein the release layer is composed of 5-nitroquiniline.

8. In an inking ribbon according to claim 5, wherein he release layer is composed of 2-chloro-analine-N-acetate.

* * * * *